US010724795B2

(12) United States Patent
Savić

(10) Patent No.: US 10,724,795 B2
(45) Date of Patent: Jul. 28, 2020

(54) HORIZONTAL PADDLE DRYER

(71) Applicant: BRINOX, D.O.O., Medvode (SI)

(72) Inventor: Slavislav Savić, Ljubljana (SI)

(73) Assignee: BRINOX, D.O.O., Medvode (SI)

( * ) Notice: Subject to any disclaimer, the term of this patent is extended or adjusted under 35 U.S.C. 154(b) by 779 days.

(21) Appl. No.: 15/303,275

(22) PCT Filed: Apr. 7, 2015

(86) PCT No.: PCT/SI2015/000015
§ 371 (c)(1),
(2) Date: Oct. 11, 2016

(87) PCT Pub. No.: WO2015/156742
PCT Pub. Date: Oct. 15, 2015

(65) Prior Publication Data

US 2017/0038143 A1 Feb. 9, 2017

(30) Foreign Application Priority Data

Apr. 7, 2014 (SI) ..... 201400132

(51) Int. Cl.
*F26B 11/16* (2006.01)
*F26B 25/00* (2006.01)
(Continued)

(52) U.S. Cl.
CPC ..... *F26B 11/16* (2013.01); *B05B 15/68* (2018.02); *B08B 3/02* (2013.01); *B08B 9/0813* (2013.01);
(Continued)

(58) Field of Classification Search
CPC ..... F26B 11/16; F26B 25/04; F26B 25/00; F26B 25/16; F26B 11/12; F26B 9/00;
(Continued)

(56) References Cited

U.S. PATENT DOCUMENTS 676,165 A * 6/1901 Wacker
1,795,094 A * 3/1931 Olsson ..... F26B 21/086 34/77
4,194,925 A * 3/1980 Holbrook ..... B01F 7/08 134/100.1

FOREIGN PATENT DOCUMENTS

CN 202955948 U 5/2013
EP 0860407 A2 8/1998
(Continued)

OTHER PUBLICATIONS

Haegeman, Marc, "International Search Report", PCT/SI2015/000015 (dated Oct. 14, 2015).

*Primary Examiner* — Edelmira Bosques
*Assistant Examiner* — Bao D Nguyen
(74) *Attorney, Agent, or Firm* — MH2 Technology Law Group LLP

(57) ABSTRACT

The object of the invention is a horizontal paddle dryer that is used for normal or vacuum drying of soaked substances that are in the form of dry powder mixtures or granulates in a manufacturing process and are soaked and mixed (normally with solvents) due to technological needs. Once drying is completed, the interior of the dryer needs to be washed due to various types of substances that differ from each other in content and properties. The construction of the horizontal paddle dryer of the invention allows simple and effective washing of the horizontal paddle dryer without an additional removal of washing heads during the washing of the dryer. The horizontal paddle dryer of the invention has a specially shaped interior wall (1) of the drum (2) that passes on the upper part through two surfaces (1*a*, 1*b*) that extend tangentially to the interior wall (1) into a horizontal final surface (1*c*) of the internal wall (1), such that a slightly concave part is created in the interior of the drum (2) in the wall (1), in which concave part retractable washing heads (3)
(Continued)

are arranged that do not hinder functioning of the rotor (4) with paddles (5) either during drying or during washing.

3 Claims, 2 Drawing Sheets

(51) Int. Cl.

| | |
|---|---|
| ***B08B 9/08*** | (2006.01) |
| ***B05B 15/68*** | (2018.01) |
| ***B08B 3/02*** | (2006.01) |
| ***F26B 25/04*** | (2006.01) |
| ***F26B 25/16*** | (2006.01) |
| *A61J 3/02* | (2006.01) |

(52) U.S. Cl.
CPC ..... *F26B 25/00* (2013.01); *F26B 25/04* (2013.01); *F26B 25/16* (2013.01); *A61J 3/02* (2013.01)

(58) Field of Classification Search
CPC .... F26B 9/06; F26B 9/08; F26B 9/082; F26B 25/06; B08B 9/0813; B08B 3/02; B08B 17/06; B08B 9/08; B08B 9/0804; B08B 3/04; B05B 15/68; B01F 15/00032; B01F 7/04; B01F 7/022; A61J 3/02
USPC ..... 34/85, 61, 179, 182, 183, 77, 184, 201, 34/209; 159/25.1; 432/103, 118; 266/173; 451/328
See application file for complete search history.

(56) References Cited

FOREIGN PATENT DOCUMENTS

| | | |
|---|---|---|
| EP | 2689833 A2 | 1/2014 |
| GB | 143846 A | 1/1921 |

* cited by examiner

HORIZONTAL PADDLE DRYER

CROSS REFERENCE TO RELATED APPLICATIONS

This application is a national-stage entry of PCT/SI2015/000015, filed Apr. 7, 2014, which claims priority to SI Patent Application P-201400132, filed Mar. 7, 2014, the contents of all of which are hereby incorporated by reference in their entirety.

The object of the invention is a horizontal paddle dryer that is used for normal or vacuum drying of soaked substances that are in the form of dry powder mixtures or granulates in a manufacturing process and are soaked and mixed (normally with solvents) due to technological needs. Once drying is completed, the interior of the dryer needs to be washed due to various types of substances that differ from each other in content and properties. The construction of the horizontal paddle dryer of the invention allows simple and effective washing of the horizontal paddle dryer without an additional removal and re-insertion of classic washing heads in all washing phases of the dryer. The invention is classified to Class F26B11/16 of the International Patent Classification.

The technical problem that is successfully solved by the present invention is a constructional solution to and an embodiment of the horizontal paddle dryer, especially of an inner wall—upper part of the dryer's drum that allows a simple and effective washing without a need to install washing heads before washing and the removal thereof after the washing in individual phases.

Horizontal paddle dryers are used for vacuum drying which is the most efficient method of drying for a majority of pharmaceutical, chemical and other, preferably food substances that are present in an industrial process in the form of dry powder mixtures or granulates and are soaked or mixed (usually with solvents) due to technological needs. Drying can also be carried out by an adequate combination of vacuum and temperature that causes evaporation of the solvent contained in a substance to be dried. Horizontal paddle dryers provide for homogeneous mixing of an inserted substance, a heat exchange factor is improved and this results in a reduced drying time.

The construction of horizontal paddle dryers consists of a substantially oblong empty cylindrical drum of a large round cross-section that is hermetically closed at one side by a cover. A rotor provided with paddles arranged at different places is arranged within the drum, said paddles allowing adequate mixing and advancement of the substance to be dried along a heated wall of the drum, wherewith the primary goal of a drying process is achieved—reduction of humidity of the inserted substance. Special shapes of the paddles of the rotor arranged within the horizontal paddle dryer provide for optimal heat exchange between a substance and the wall of the drier.

After drying of a mixture of powders or granulates that are soaked and mixed with solvents due to technological needs, the remains of the treated substance, solvents and other admixtures that remain after the removal of the treated substance need to be removed from the horizontal paddle dryer. The interior of the dryer (walls, edges, rotor paddles) need to be thoroughly washed. When cleaning the remains of pharmaceutical substances for instance, washing needs to be performed in following steps: washing with potable cold water, washing with detergents (once or twice), washing with potable cold water, washing with clean purified water, drying with hot pharmaceutical air.

Prior to washing the interior of known horizontal paddle dryers washing heads of any shapes must be installed and flanges are foreseen for this purpose on the circumference of the dryer's drum. The heads are removed during a drying procedure of the dryer since their installation would disturb a free rotation of the rotor with the paddles, whereas during a washing phase, i.e. in a non-operative phase of the rotor, the washing heads are inserted. The washing heads reach so far in the interior of the drum that rotation of the rotor with the paddles is made impossible during the washing. The washing heads are therefore arranged on the upper circumferential part of the drum in a way that a jet of a liquid does not reach all drum parts and the standing rotor with the paddles when washing is in course. Based on what has been described, the washing process in known embodiments of horizontal paddle dryers is very time consuming as the dryer needs to be prepared for washing each time separately (installation of the washing heads). Although several washing heads are installed they fail to reach all parts—surfaces of the interior of the drum (i.e. the not exposed surfaces of the paddles and the drum).

The horizontal paddle dryer of the invention does away with the drawbacks of known embodiments by a specially shaped drum, the interior wall of which does not have a perfectly round shape but an interior wall extends on the upper part through two surfaces that extend tangentially to the interior wall of the drum into a horizontal final part, such that a slightly concave part is created in the interior of the drum, in which retractable washing heads are arranged that do not hinder functioning of the rotor with paddles and need therefore not be removed during the functioning of the horizontal paddle dryer of the invention.

The invention will be explained in more detail by way of an embodiment and the enclosed drawings, on which FIG. 1 shows a view of a horizontal paddle dryer of the invention without a front cover;

Figure 1:
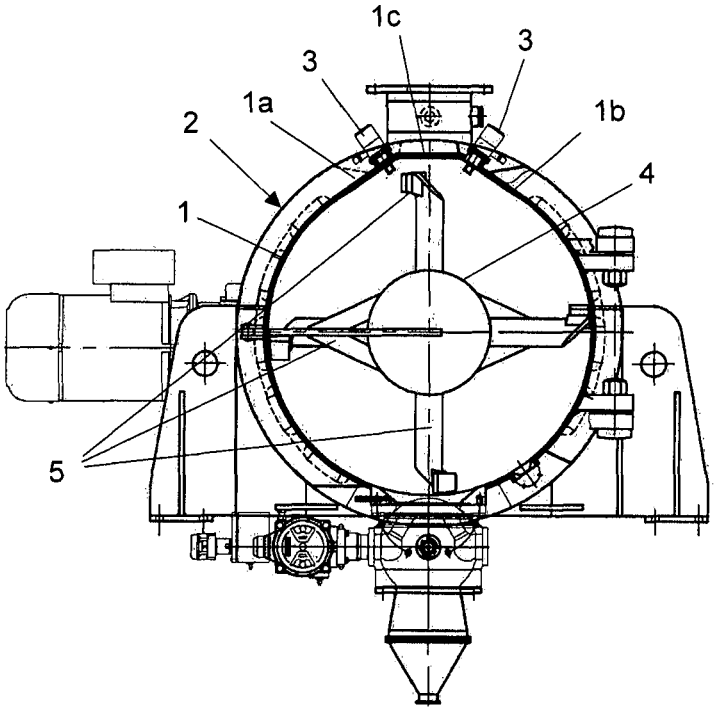
Figure 2:
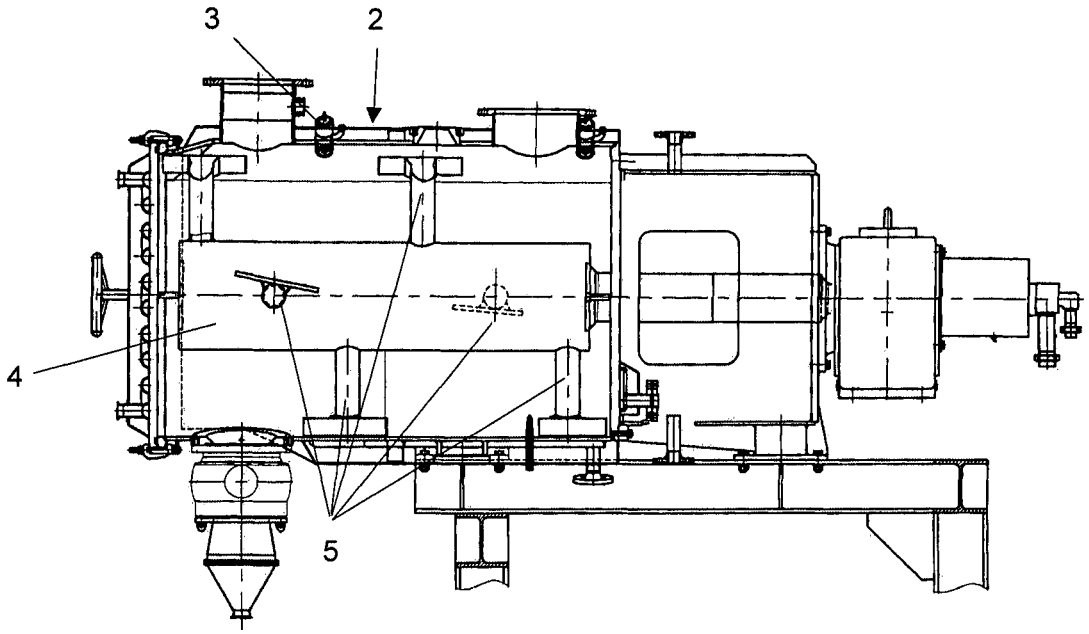
FIG. 2 shows a side view of a horizontal paddle dryer of the invention in partial cross-section.
Figure 3:
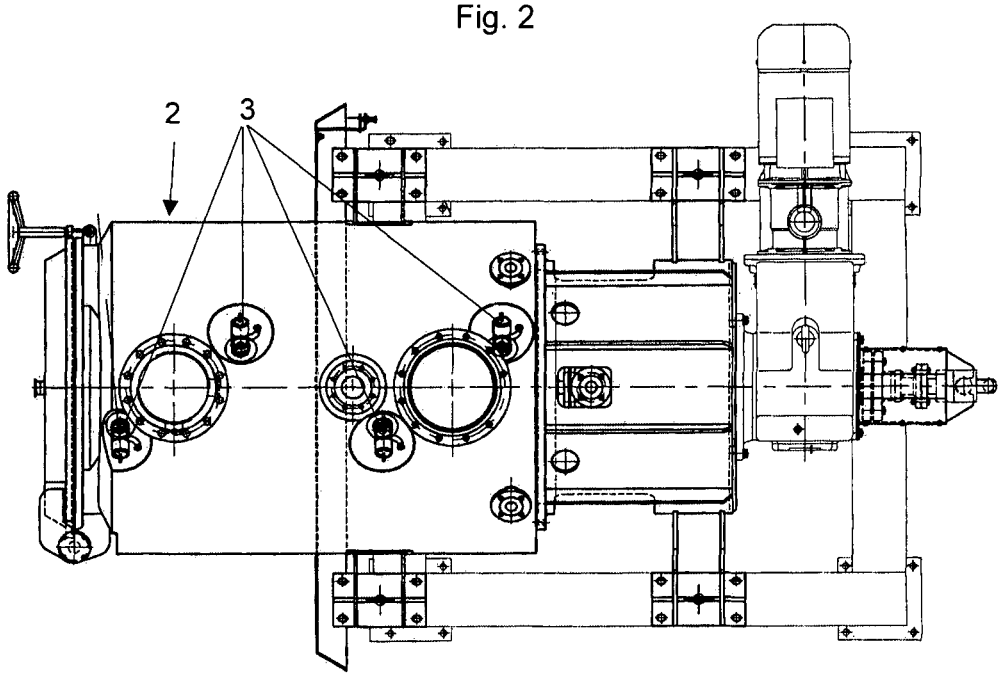
FIG. 3 shows a top view of a horizontal paddle dryer of the invention.

A horizontal paddle dryer of the invention that is shown in the enclosed figures has an internal wall 1 of an oblong, substantially cylindrically shaped drum 2 that is reshaped at the top as shown in FIG. 1. The internal wall 1 passes from a round shape into two sections 1*a*, 1*b* that extend tangentially to the internal wall 1, said sections merging at the top with a horizontally arranged section 1*c* of the internal wall 1. A concave part of the internal wall 1 along the entire length of the drum 2 is thus created.

A rotor 4 with paddles 5 is arranged within the drum 2. It is evident from FIG. 1 that the paddles 4 which closely touch the internal wall 1 of the drum 2 do not touch the arranged retractable washing heads 3.

In this way a space is created at the top of the internal wall of the dryer of the invention that allows a permanent insertion of the retractable washing head 3 in the dryer's drum 2 in the area of sections 1*a* and 1*b* of the internal wall 1 without the heads disturbing the functioning of the dryer.

Due to the permanently inserted retractable washing heads 3 which are in a closed-tighten position during the drying phase and allow undisturbed operation of the dryer, washing of the interior of the drum 2 is simplified as the washing heads need not be inserted and removed in each individual washing phase. Besides, the rotor with the paddles can rotate during the washing and this provides for a more rapid and more effective washing of the horizontal dryer. Additionally, there are no covered surfaces that cannot be reached by the washing head during washing.

The invention claimed is:

1. A horizontal paddle dryer, comprising:

a drum;

a rotor with paddles arranged in the drum;

an internal wall within the drum, the internal wall comprising:

a circular lower portion, two diagonal surfaces that each tangentially extend on opposite sides of the circular lower portion, and a horizontal surface between and connecting opposite distal ends of the diagonal surfaces, wherein the circular lower portion, the diagonal surfaces, and the horizontal surface of the internal wall of the drum form a concavity; and washing heads arranged at the opposite distal ends of the horizontal surface at points in which the horizontal surface connects to and meets the diagonal surfaces, wherein the horizontal surface is in between the washing heads.

2. The horizontal paddle dryer according to claim 1, wherein the washing heads are arranged as to not hinder functioning of the rotor with paddles.

3. The horizontal paddle dryer according to claim 2, wherein the washing heads are arranged within the drum during both a drying phase and a washing phase.

* * * * *